US011882925B2

(12) United States Patent
Ilonze

(10) Patent No.: US 11,882,925 B2
(45) Date of Patent: Jan. 30, 2024

(54) DISPENSING HAIR BRUSH SYSTEM

(71) Applicant: Chilon Industries, LLC, Falls Church, VA (US)

(72) Inventor: Paula Chinenye Ilonze, Falls Church, VA (US)

( * ) Notice: Subject to any disclaimer, the term of this patent is extended or adjusted under 35 U.S.C. 154(b) by 90 days.

(21) Appl. No.: 17/327,720

(22) Filed: May 23, 2021

(65) Prior Publication Data

US 2022/0369799 A1 Nov. 24, 2022

(51) Int. Cl.
*A46B 11/00* (2006.01)
*A46B 7/04* (2006.01)

(52) U.S. Cl.
CPC ..... *A46B 11/0027* (2013.01); *A46B 7/042* (2013.01); *A46B 11/0062* (2013.01); *A46B 2200/104* (2013.01)

(58) Field of Classification Search
CPC . A46B 11/0027; A46B 11/0062; A46B 7/042; A46B 2200/104
See application file for complete search history.

(56) References Cited

U.S. PATENT DOCUMENTS 1,382,161 A * 6/1921 Bates ..... A46B 11/0027 401/172
1,465,220 A * 8/1923 Huether ..... A46B 11/0027 401/172
4,890,349 A * 1/1990 Nitzsche ..... A46B 7/042 15/176.5
6,276,367 B1 * 8/2001 Piatetsky ..... A46B 11/0006 132/115
2008/0041416 A1 * 2/2008 Mathews ..... A46B 11/0055 15/159.1
2015/0272313 A1 * 10/2015 Alsalameh ..... A46B 11/0006 401/28
2018/0153295 A1 6/2018 Pilevsky et al.

FOREIGN PATENT DOCUMENTS

DE 10006707 A1 * 8/2001 ..... A45D 24/24
EP 1075806 A1 * 2/2001 ..... A46B 5/0095
GB 2066059 A * 7/1981 ..... A45D 24/22

* cited by examiner

*Primary Examiner* — Patrick M. Buechner
(74) *Attorney, Agent, or Firm* — Darrell G. Mottley

(57) ABSTRACT

A hair brush system includes a brush housing having a handle neck portion and a fluid reservoir for holding a viscous fluid therein. The fluid reservoir is disposed within the brush housing. The hair brush system includes a plunger plate for engaging in the fluid reservoir of a gel or other viscous fluid product. The plunger plate is disposed within the brush housing. Valve devices are dispersed in a brush head, wherein the valves are fluidly coupled to the reservoir upon movement of the plunger plate from a first position to a second position upon engagement of a user.

19 Claims, 14 Drawing Sheets

DISPENSING HAIR BRUSH SYSTEM

FIELD OF THE DISCLOSURE

The present disclosure generally relates to a dispensing hair brush system and method, more particular to disclosure pertains to a fluid dispensing hair brush.

BACKGROUND

The medical and cosmetic industry has developed many products that may be used to apply liquid to the hair or the scalp, but few to none of those products are geared towards consumers with textured hair. Textured hair encompasses wavy, curly, and coily hair. People with those hair types require thicker products to style their hair and spend two to three times more money and longer time maintaining it.

A typical manual hair brush is designed to help groom and detangle the hair. People with textured hair currently have to pour hair products (conditioners, gels, creams, etc.) onto their hands and smooth it through with their fingers. They then use a manual hair brush to smooth it in. This method is often messy and inconvenient. Another method of distributing product onto the hair is to place the product in a container having a relatively long spout. The person then squeezes the container with the spout adjacent the hair so that the liquid is applied directly to the hair shaft. One problem with this type of application is that the liquid often runs off of the hair before it can be rubbed in by the person's hands.

SUMMARY

In light of the foregoing background, the following presents a simplified summary of the present disclosure in order to provide a basic understanding of some aspects of the disclosure. This summary is not an extensive overview of the disclosure. It is not intended to identify key or critical elements of the disclosure or to delineate the scope of the disclosure. The following summary merely presents some concepts of the disclosure in a simplified form as a prelude to the more detailed description provided below.

Various aspect of the present disclosure relates to dispensing hair brush and method of operation. In one aspect, a hair brush system includes a brush housing having a handle neck portion and a fluid reservoir for holding a fluid therein. The fluid reservoir is disposed within the brush housing. The hair brush system includes a plunger plate for engaging in the fluid reservoir of gel or other fluid product. The plunger plate is disposed within the brush housing. Valve devices are provided in a bristle pad, wherein the valves are fluidly coupled to the reservoir upon movement of the plunger plate from a first position to a second position upon engagement of a user. The dispensing hair brush is capable of styling or detangling the hair and ensuring an improved and more efficient hair routine.

In another aspect, a hair brush apparatus, a brush housing having a handle neck portion and a fluid reservoir for holding a fluid. The fluid reservoir is formed within the brush housing. A brush head may include a base or bristle pad with hair shaping elements extending from the base or bristle pad. The brush head may be removably coupled to the brush housing. A plunger plate may be configured for linearly engaging towards the brush head and in the fluid reservoir while the plunger plate is disposed within the brush housing. A plurality of valves disposed in the base or bristle pad, wherein the valves are fluidly coupled to the reservoir to dispense the fluid upon movement of the plunger plate from a first position to a second position upon engagement of a user.

These and other features, and characteristics of the present technology, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of 'a', 'an', and 'the' include plural referents unless the context clearly dictates otherwise.

DETAILED DESCRIPTION

Figure 1:
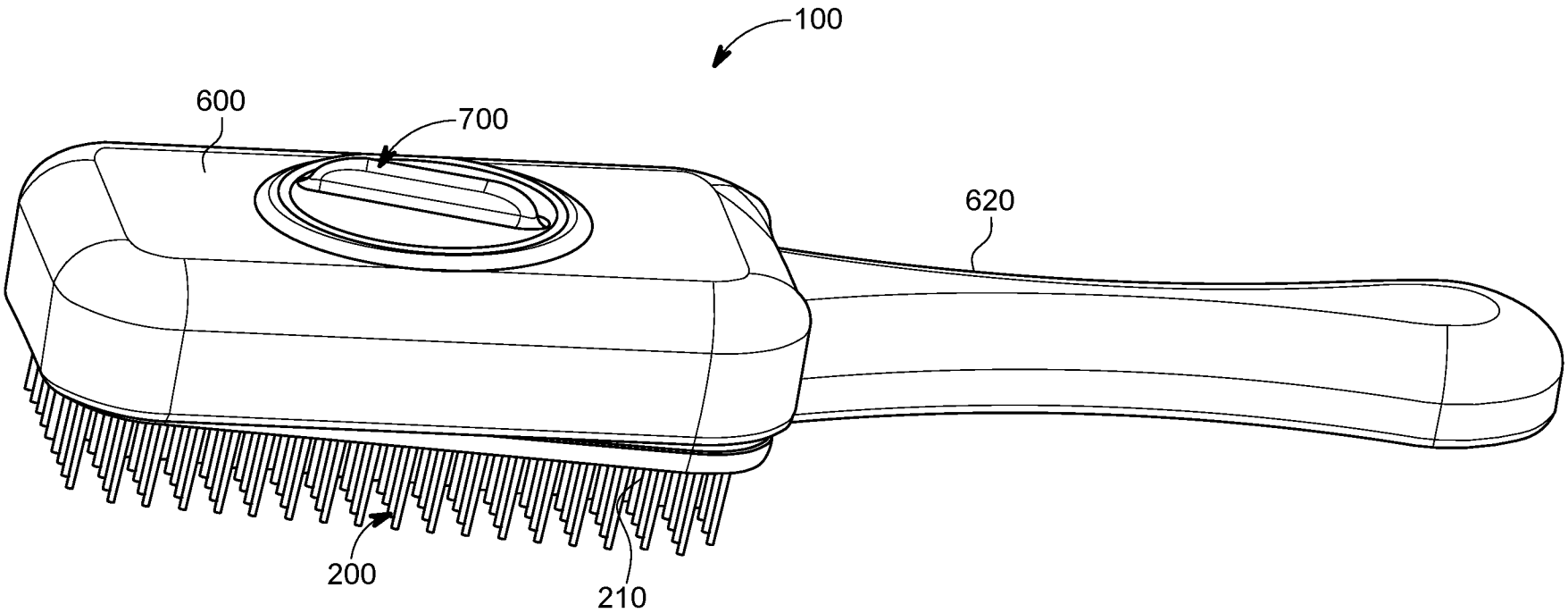
FIG. 1 illustrates a perspective schematic side view of a brush system in unlocked position of a brush head to a brush housing in which certain aspects of the present disclosure may be implemented.
Figure 2:
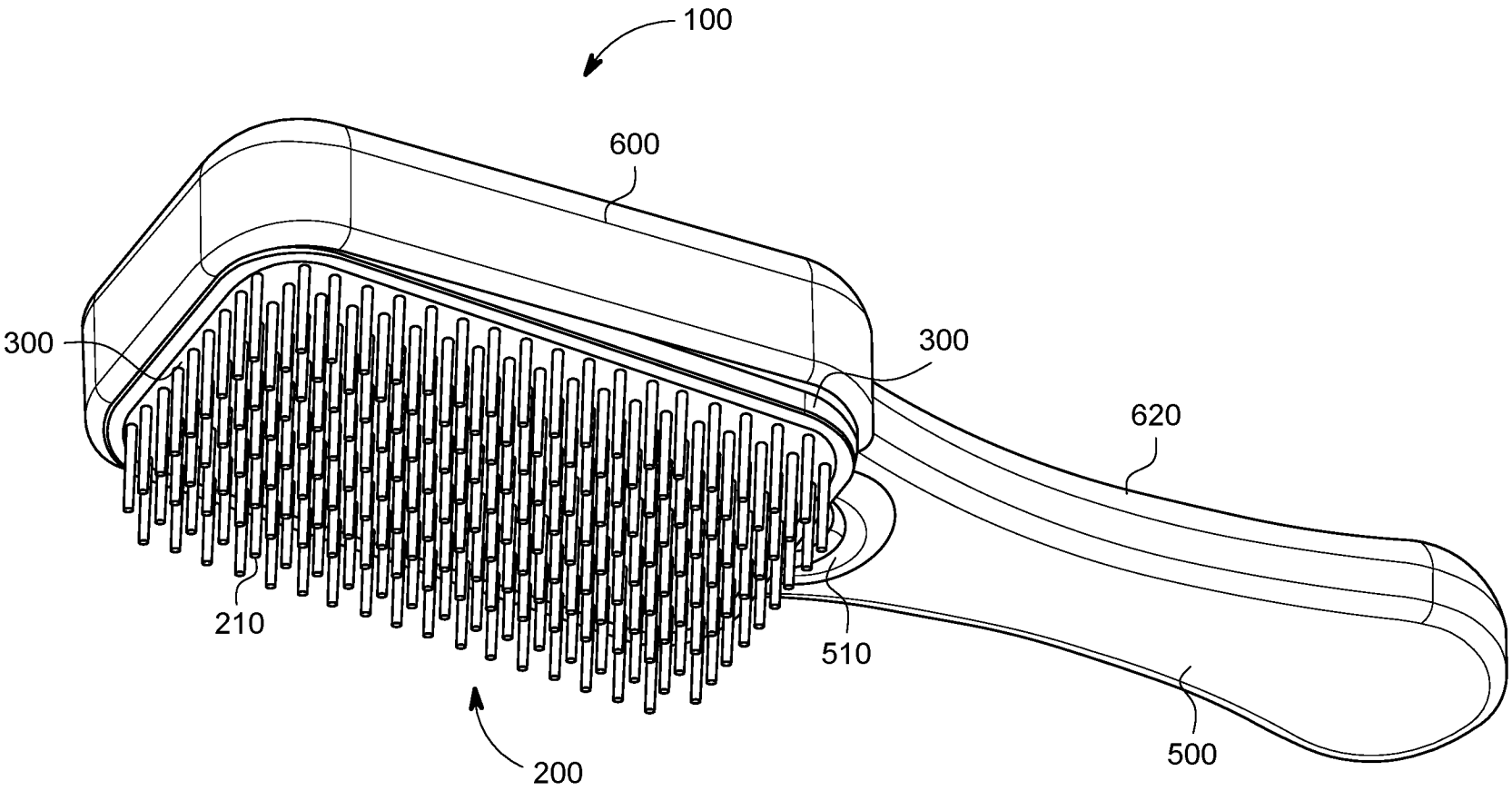
FIG. 2 illustrates a perspective schematic side view of the brush system in which certain aspects of the present disclosure may be implemented.
Figure 3:
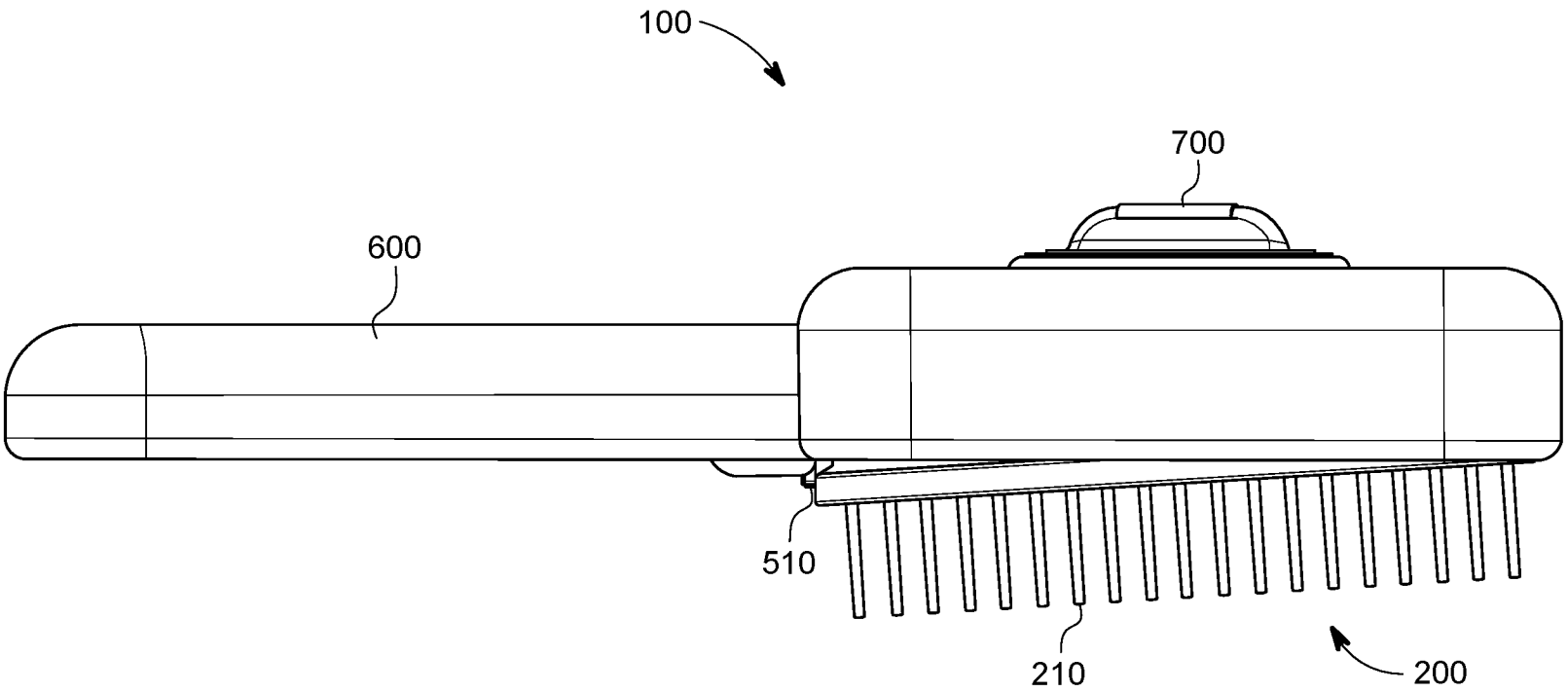
FIG. 3 illustrates a schematic side view of the brush system in accordance with one or more constructions and implementations of the present disclosure.
Figure 4:
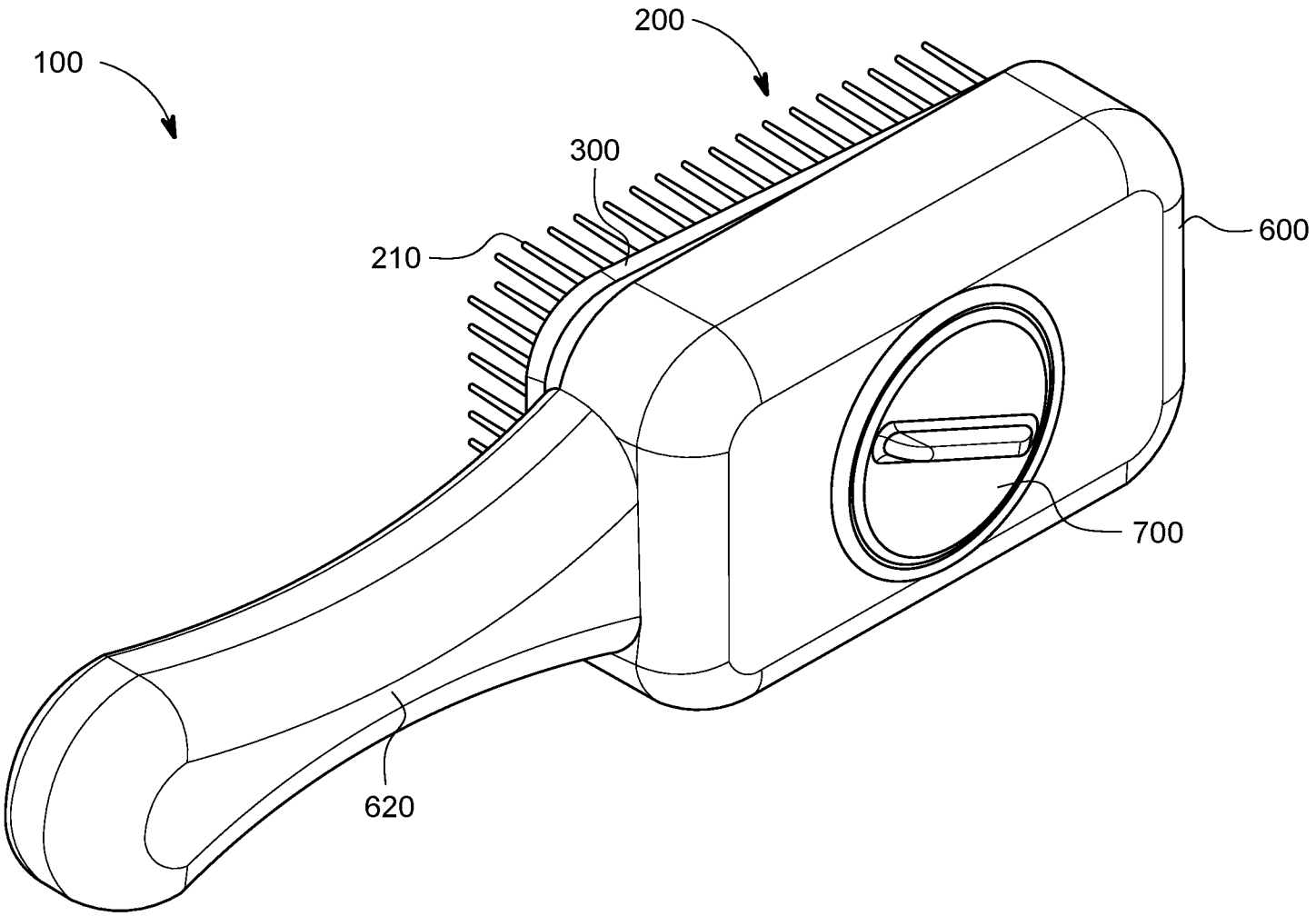
FIG. 4 illustrates a perspective schematic back view of the brush system in accordance with one or more constructions and implementations of the present disclosure.
Figure 5:
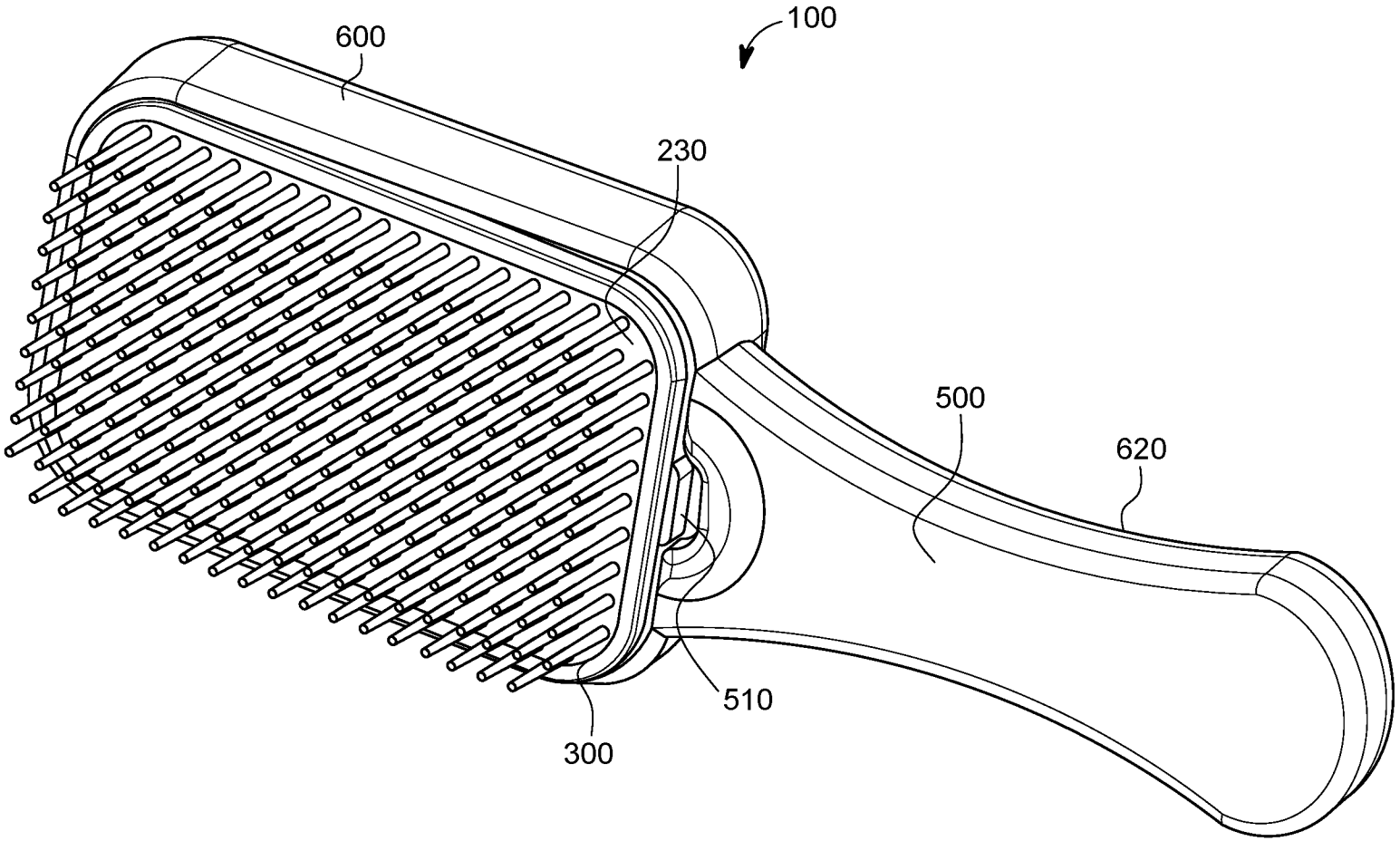
FIG. 5 illustrates a perspective schematic view of the brush system in accordance with one or more constructions and implementations of the present disclosure.

In the following description of the various embodiments, reference is made to the accompanying drawings, which form a part hereof, and in which is shown by way of illustration, various embodiments in which the disclosure may be practiced. It is to be understood that other embodiments may be utilized and structural and functional modifications may be made.

As illustrated in the FIGS. 1-14, a hair brush system 100 enables a viscous fluid product to be discharged from the brush housing/fluid housing 600 onto the hair of a human (for example). The brush system 100 dispenses fluids, such as hair gel or hair conditioners, from a valve when pushing the plunger from a first location to a second location. In one construction, a viscous fluid contained within the hair brush system 100 is prevented from being dispensed while stored inside of the brush until the fluid is distributed from the valve. In one or more constructions, the brush system 100 may include a brush head 200, bristle pad 230, a seal 300, a plunger plate 400, a neck 500, a brush housing/fluid housing 600, and a plunger top 700. The brush housing 600 retains the brush head 200, seal 300, plunger plate 400, neck 500, and plunger top 700 therein. The housing 600 can be of an extruded or injected molded flexible or resilient plastic material.

Figure 6:
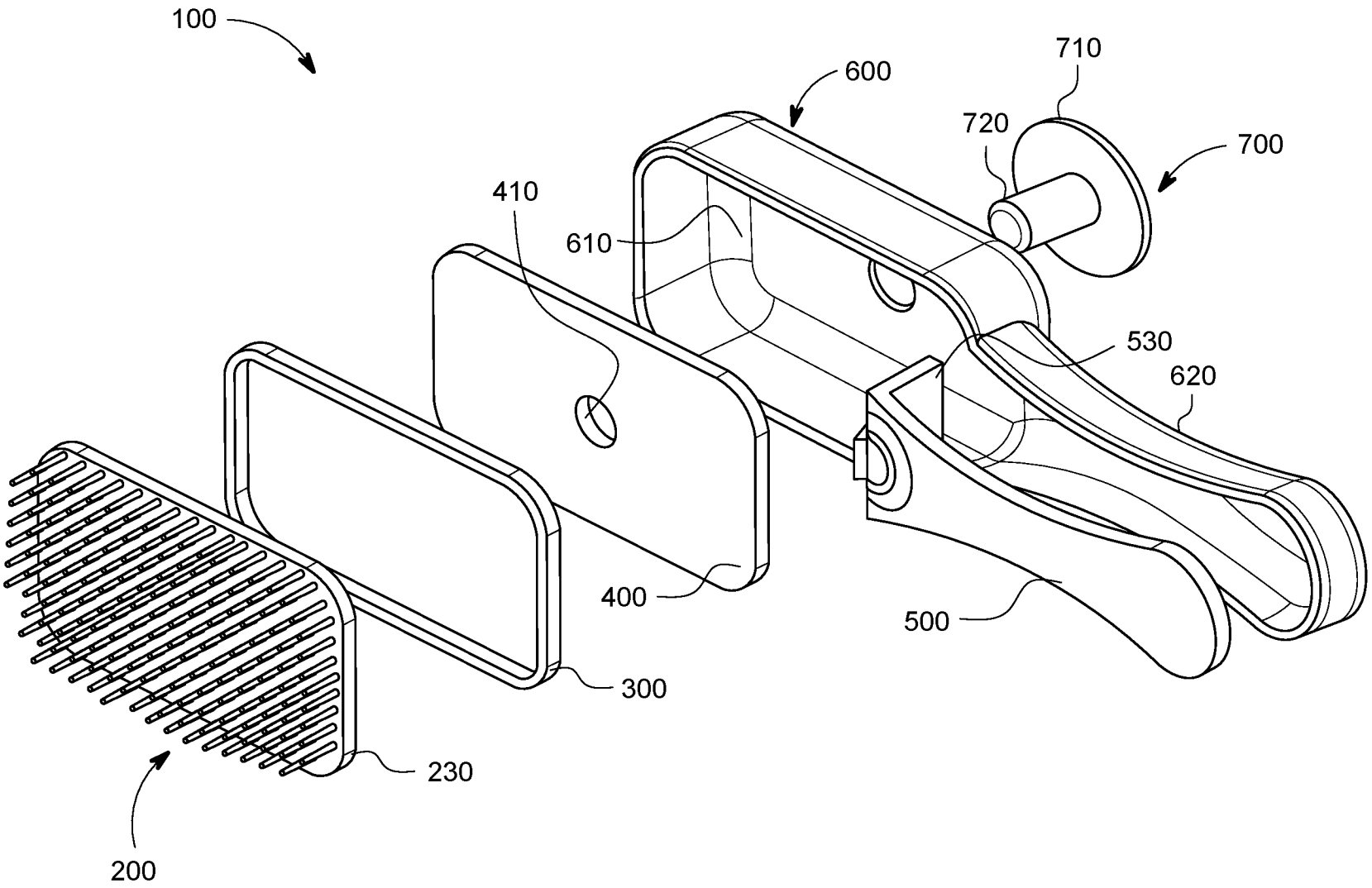
FIG. 6 illustrates an exploded schematic view of the brush system in accordance with one or more constructions and implementations of the present disclosure.
Figure 7:
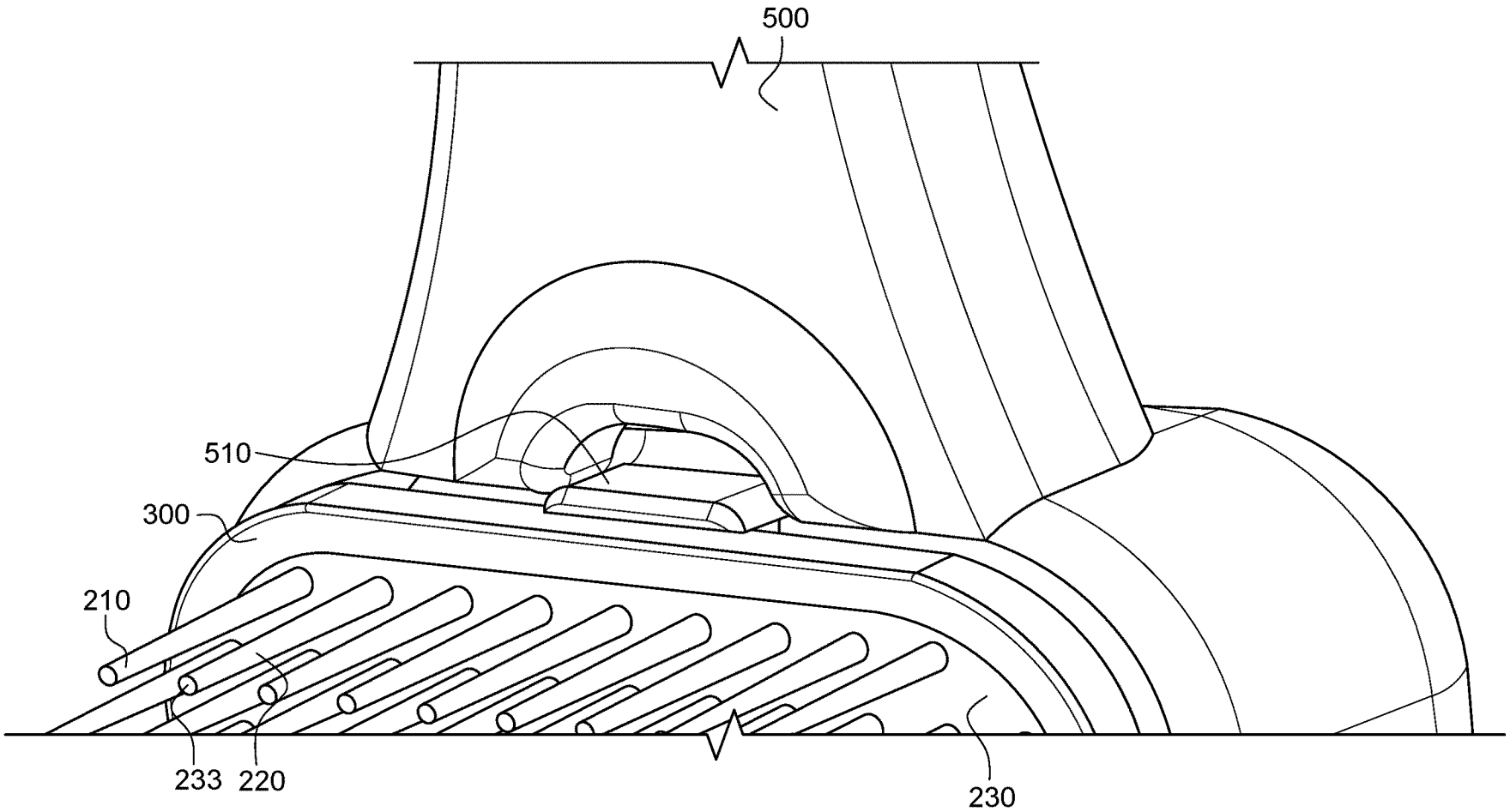
FIG. 7 illustrates a fragmentary enlarged view of the brush system in accordance with one or more constructions and implementations of the present disclosure.

Referring to FIGS. 1-7, the brush head 200 can be of a plastic molded configuration, including injection molding. Turning to FIG. 7, the brush head 200 includes a plurality of hair shaping elements 210, such as bristles, in which each bristle 210 has an elongated body 220 with a circular cross-section that gradually tapers as each bristle 210 extends upward from the brush base or bristle pad 230. In one construction, the tips 223 of the bristles 210 have a flat configuration. In another construction, the tips 223 of each of the bristles 210 may have other shapes such as a round or convex shape. For example, a bristle may have a hemispherical tip. Bristles 210 may have a solid or hollow cross-section. The bristles 210 can be of an extruded or injected molded flexible or resilient plastic material. Potential materials used to form bristles 210 may include ethylvinyl acetate, polyurethane, polypropylene, polyethylene, or other thermoplastics. Brush base 230 and bristles 210 can be made from the same materials or different materials. The bristles 210 and pad 230 can be integrally molded into a unitary construction. Alternatively, the bristles 210 can be attached to the brush base 230 by various methods including bonding or ultrasonic bonding methods. Other forms of mounting could be through various plastic welding techniques such as ultrasonic, induction welding, orbital friction welding, hot wire welding, etc. The bristles 210 can be provided in various patterns on the brush base. In one implementation, the bristles 210 may be in 17 columns and 11 rows, evenly spaced in the surface area of the base/bristle pad 230. Nevertheless, the bristles 210 may be in different patterns and spaced unevenly in different constructions.

In one implementation, hair shaping elements are bristles 210 as previously described. The technology could be practiced broadly where the term hair shaping elements is used in a generic sense which could include fiber bristles or massage elements or other forms of hair elements such as elastomeric fingers or walls arranged in a circular cross-sectional shape or any other type of desired shape including straight portions or sinusoidal portions.

Referring to FIGS. 1-6, seal 300 enables a fluid tight or airtight seal between the bristle pad 230 and brush housing 600. The fluid stays retained in the fluid reservoir 610 disposed in the interior of the brush housing 600. The seal 300 may be resiliently disposed along on the perimeter of the bristle pad 230 for a tight mechanical squeeze fit. In other words, the bristle pad 230 is disposed within the seal 300 interior. In other constructions, the seal 300 can be adhesively bonded to the pad 230 perimeter. The seal 300 can be constructed of several materials, such as silicone or an elastomer.

Figure 8:
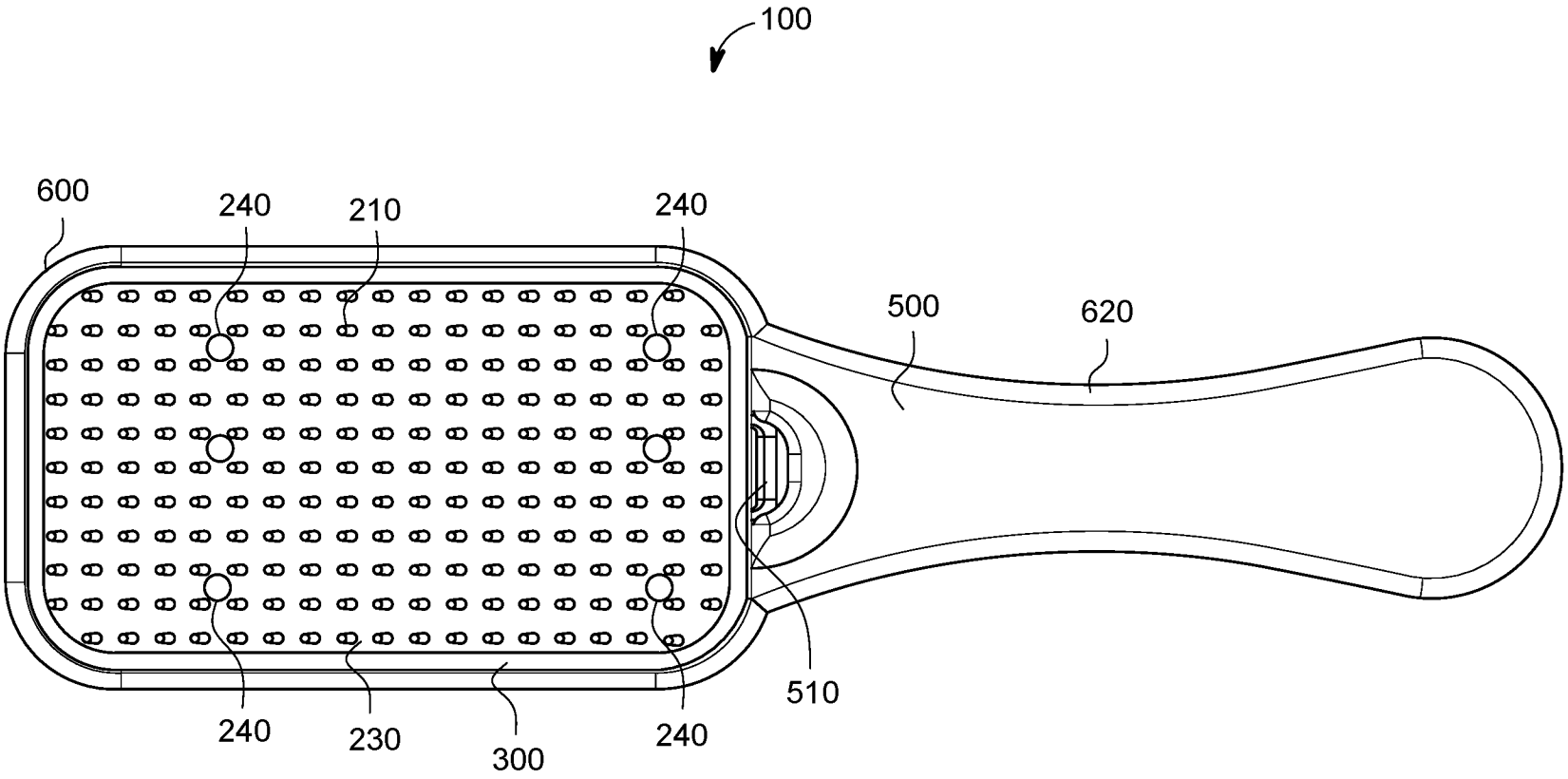
FIG. 8 illustrates a schematic plan view of the brush system showing valves in accordance with one or more constructions and implementations of the present disclosure.
Figure 9:
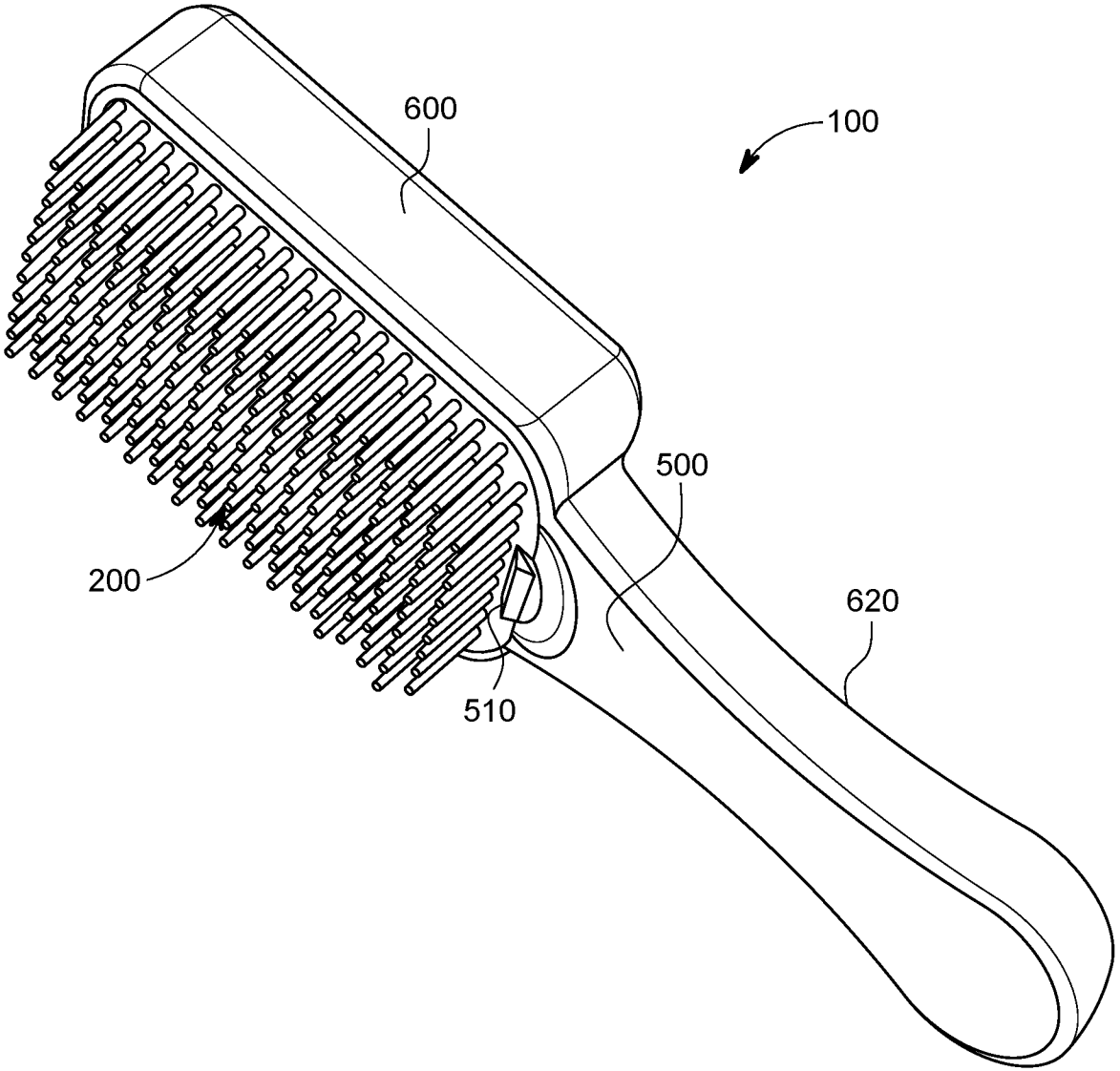
FIG. 9 illustrates a perspective view of the brush system in a locked state in accordance with one or more constructions and implementations of the present disclosure.

Referring to FIGS. 6, 8, 10, and 11, plunger plate 400 is located within the interior of brush housing 600 to dispense viscous liquids from valves 240. In operation, the plunger plate compresses the viscous liquids within the reservoir 610 towards the valves 240 to dispense the liquids from the brush head 200. While FIG. 8, shows six valves 240, the number of valves 240 can be more or less than six. For example, number of valves 240, can be eight, ten, or eleven to provide improved dispensing of viscous liquid.

Figure 10:
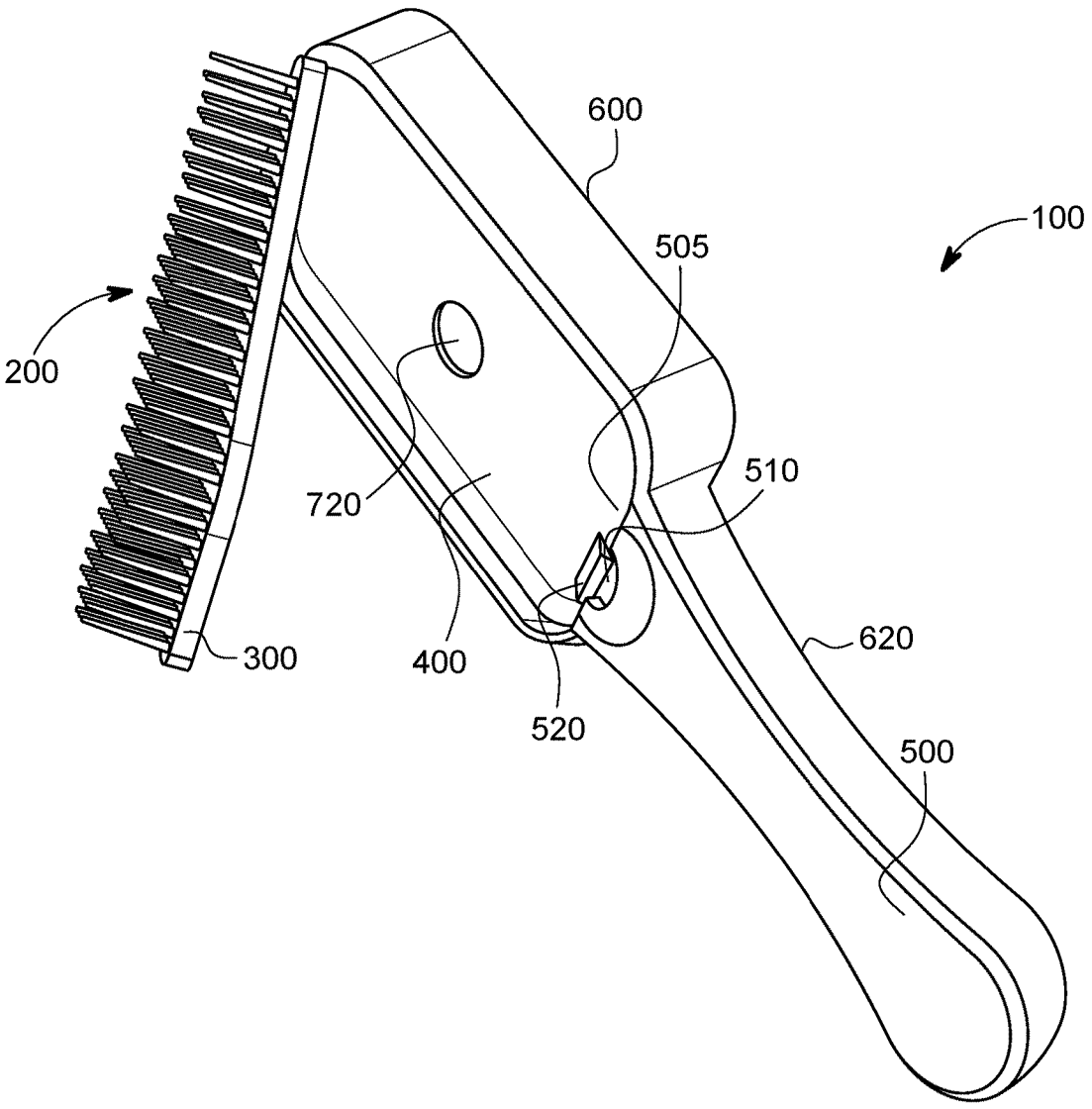
FIG. 10 illustrates a perspective view in which the brush head is in an unlocked state to reveal the inside of the reservoir and plunger construction in accordance with one or more constructions and implementations of the present disclosure.
Figure 11:
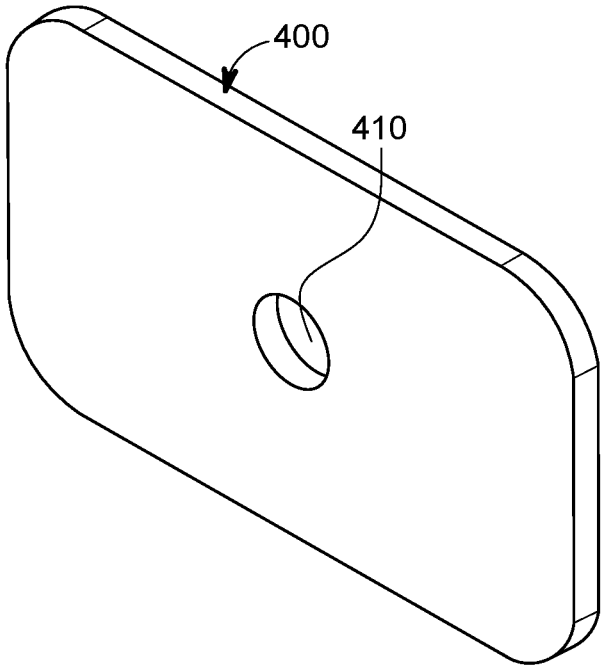
FIG. 11 illustrates a perspective view of a plunger plate construction in accordance with one or more constructions and implementations of the present disclosure.
Figure 12:
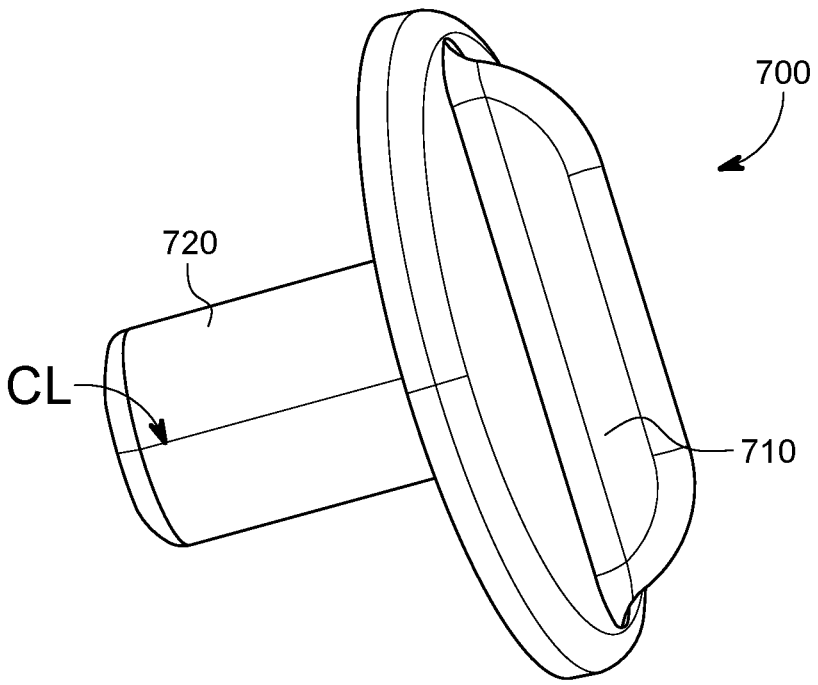
FIG. 12 illustrates a perspective view of a plunger construction in accordance with one or more constructions and implementations of the present disclosure.
Figure 13:
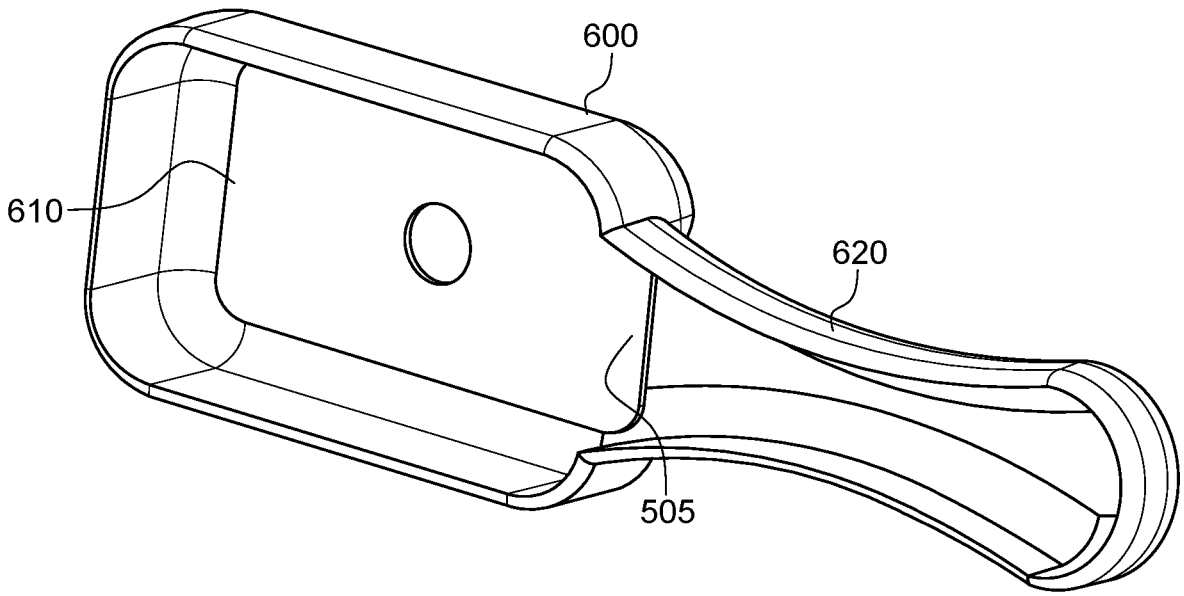
FIG. 13 illustrates a perspective view of a brush housing and fluid reservoir in accordance with one or more constructions and implementations of the present disclosure.

Referring to FIGS. 6,10, and 12, plunger 700 is mechanically connected to the plunger plate 400 by way of a threaded arrangement with hole 410. Plunger 700 includes a knob 710 and a threaded cylindrical shaft 720 extending from the knob 710. The shaft 720 has threads which engage with a complementary thread in the hole 410 of the plunger plate 400. The shaft 720 has a threaded configuration for simultaneous rotation about a center axis CL of the plunger 700 and linear movement along the center axis CL for engaging the plunger plate 400. In one construction, the knob 710 and shaft 720 can be integrally molded into a unitary construction of the plunger 700. Alternatively, the knob 710 can be attached to the shaft 720 by various methods including bonding or ultrasonic bonding methods. Other forms of mounting could be through various plastic welding techniques such as ultrasonic, induction welding, orbital friction welding, hot wire welding, etc. The plunger plate 400 and plunger 700 can be of constructed of an extruded or injected molded flexible or resilient plastic material. Potential materials used to form plunger plate 400 and plunger 700 may include ethylvinyl acetate, polyurethane, polypropylene, polyethylene, or other thermoplastics.

Figure 14:
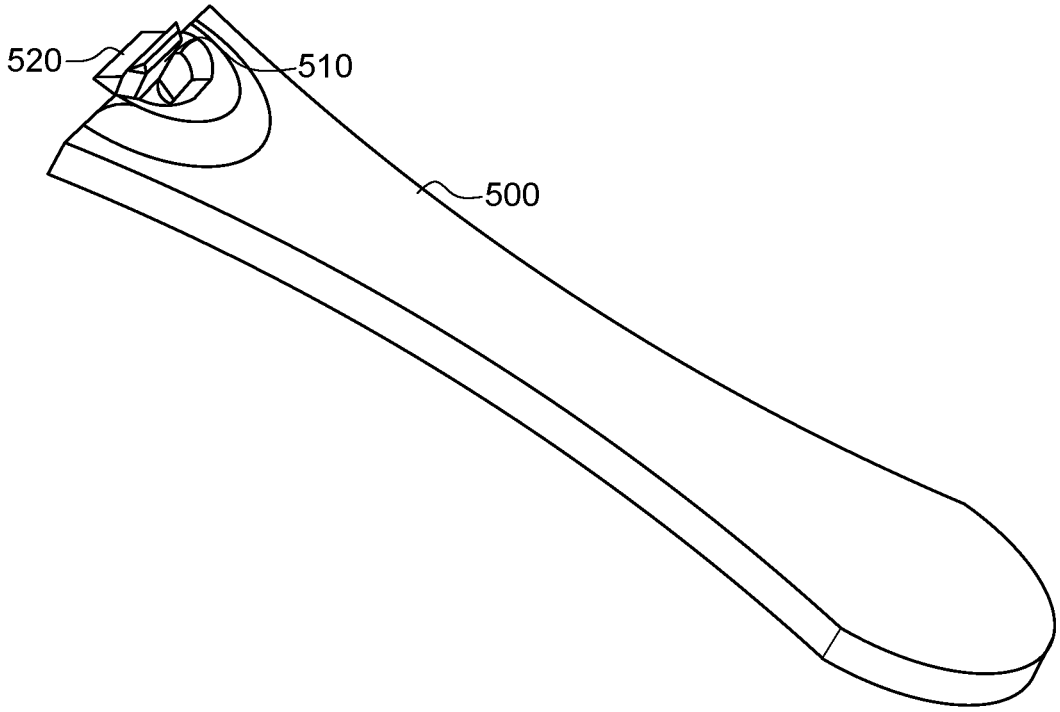
FIG. 14 illustrates a perspective view of a neck construction in accordance with one or more constructions and implementations of the present disclosure.

Referring to FIGS. 6, 10, 14, neck 500 compatibly engages the handle portion 620 of the brush housing 600. The reservoir end 505 of the neck 500 includes a snap fit lever 510 designed as a beam type snap-fit configuration. The snap fit lever 510 is resiliently constructed with a stiffness which enables bending deflection of the distal lock head 520 to snap back into a locked position against the brush head 200. This snap fit construction enables the brush head 200 to be removably coupled to the brush housing 600 to allow ease of operation. In one construction, the lever 510 may have a rectangular cross-section that gradually tapers upward from the lock head 520. In another construction, the lever 510 may have a rectangular cross-section that remains constant up to the lock head 520. The neck 500, including the snap fit lever 510, can be of an extruded or injected molded flexible or resilient plastic material. The neck 500 includes a wall 530, best seen in FIG. 6, which extends into the housing 600. The wall 530 engages the interior of the housing 600 at end 505 to form a portion of the reservoir 610 (see FIG. 13 for the end 505). In one construction, the neck 500 can be integrally molded into a unitary construction of the brush housing 600. In alternative constructions, the neck 500 can be attached to the brush housing 600 by various methods including bonding or ultrasonic bonding methods. Other forms of mounting could be through various plastic welding techniques such as ultrasonic, induction welding, orbital friction welding, hot wire welding, for example.

Referring to FIGS. 1-14, brush housing 600 retains the brush head 200, seal 300, plunger plate 400, neck 500, and plunger top 700 therein. The housing 600 can be of an extruded or injected molded flexible or resilient plastic material. In other constructions, the housing 600 can be made in a molded configuration of a bamboo sheet material. The bamboo enables an environmentally sustainable hair brush system 100 of a renewable natural material. The dispensing hair brush 100 is capable of styling, cleansing providing care for the hair with a viscous liquid product, while detangling. The hair brush system 100 includes the brush housing 600 having a handle neck 500 and a fluid reservoir 610 for holding a viscous liquid. The fluid reservoir 610 is formed within the brush housing 600. The brush head 200 includes the bristle pad 230 with hair shaping elements 210 extending from the pad 230. The brush head 200 may be removably coupled to the brush housing 600. The plunger plate 400 may be configured for linearly engaging towards the brush head 200 and in the fluid reservoir 610, while the plunger plate 400 is disposed within the brush housing 600. A plurality of valves 240 are disposed in the pad 230 to dispense a viscous hair product.

In one operation of the brush system 100 to fill the reservoir with a hair product, such as a gel, the brush head 200 is disengaged from the brush housing 200 by springing back the snap fit lever 510 towards the distal end of the handle 620 of housing 200. This action enables the brush head 200 to become free from the housing 200 to reveal the plunger plate 400 in the reservoir 610. The plunger plate 400 may be located at the top of the reservoir 610 in the brush housing 600. The viscous product is placed in the reservoir 610 or otherwise fills the reservoir 610. The bristle pad 230 and seal 300 is then placed over the reservoir 610 and snapped back into position in the brush housing 600.

To dispense the viscous product, the user may force the plunger plate 400 downward by twisting the knob 710 (for example, counter-clockwise) which rotates the threaded shaft 720 and linearly moves the threaded plunger plate 400 down the shaft 720 towards the brush head 200. The movement of the plunger plate 400 towards the brush head 200 pushes the viscous product (such, as a gel) against the bristle pad 230 and subsequently through the valves 240 onto the hair shaft 210. Hence, the user has control of the amount of gel dispensed by increasing or decreasing the number of times they twist the knob 710. To reduce dispensing of gel, the user may rotate the knob 710 clockwise which moves the plunger plate 700 away from the brush head 200. The valves 240 disposed in the bristle pad 230 apply the gel directly to the hair shafts while the user is brushing with the hair brush system 100. Thus, by using brush system 100, a person can successfully style textured hair by way of even product application and distribution to ensure moisture, curl definition and reduce frizz. Nevertheless, in one implementation, the rotating of the knob 710 may be rotated clockwise to move the plate 400 towards the brush head 200. Likewise, the knob 710 may be rotated counter-clockwise to move the plate 400 away from the brush head 200.

After most of the viscous product is dispensed, the reservoir 610 can be filled with more product. In one operation of the brush system 100, the brush head 200 may be disengaged from the brush housing 600 by springing back the snap fit lever 510 towards the distal end of the handle 620 of housing 600. This action enables the brush head 200 to become free from the housing 600 to reveal the plunger plate 400 in a lower location of the reservoir 610 at end of the dispensing position. The user may rotate the knob 710 (for example, clockwise) which moves the plunger plate 700 towards the top reservoir 610 of the brush housing 600. The viscous product is poured into the reservoir 610 or otherwise fills the reservoir 610. The brush head 200 is then placed over the reservoir 610 and snapped back into position in the brush housing 600 and ready for use.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation and including use on human hair or animal hair for grooming purposes.

What is claimed is:

1. A hair brush apparatus, comprising:

a brush housing having a handle neck portion;

a fluid reservoir for holding a fluid therein and the fluid reservoir being formed within the brush housing;

a brush head having a pad with hair shaping elements extending therefrom; wherein the pad is removably coupled to the brush housing;

a plunger plate for linearly engaging towards the brush head and in the fluid reservoir and the plunger plate being disposed within the brush housing; and a plurality of valves disposed in the pad, wherein the valves are fluidly coupled to the reservoir to dispense the fluid upon movement of the plunger plate from a first position to a second position upon engagement of a user; wherein the brush housing further comprises an insertable neck forming a part of the handle and a part of the reservoir.

2. The apparatus according to claim 1, wherein the pad forms a portion of the reservoir.

3. The apparatus according to claim 1, further comprising a snap fit lever in the neck handle for removably engaging the pad.

4. The apparatus according to claim 1, further comprising a plunger operable with the plunger plate.

5. The apparatus according to claim 4, wherein the plunger further comprises a knob and a shaft connected to the knob.

6. The apparatus according to claim 5, further wherein the shaft has a threaded configuration for simultaneous rotation about a center axis and linear movement of the plunger plate along the center axis for engaging a fluid in the reservoir.

7. The apparatus according to claim 1, further comprising a seal disposed around a perimeter of the pad.

8. The apparatus according to claim 7, further comprising a snap fit lever in the neck handle for removably engaging the pad.

9. The apparatus according to claim 8, wherein the pad forms a portion of the reservoir.

10. The apparatus according to claim 9, wherein the handle neck portion forms a vertical portion of the reservoir.

11. A hair brush apparatus, comprising:

a brush housing having a handle;

a fluid reservoir being formed within the brush housing;

a brush head including hair shaping elements extending therefrom;

wherein the brush head is removably coupled to the brush housing;

a plunger plate configured to linearly engage towards the brush head and in the fluid reservoir, and the plunger plate being disposed within the brush housing; and a plurality of valves disposed in the brush head, wherein the valves are fluidly coupled to the reservoir to dispense the fluid upon movement of the plunger plate from a first position to a second position towards the brush head; wherein the brush housing further comprises an insertable neck forming a part of the handle and a part of the reservoir.

12. The apparatus according to claim 11, wherein the brush head further comprises a seal which forms a portion of the reservoir.

13. The apparatus according to claim 11, further comprising a snap fit lever in the handle for removably coupling the brush head thereto.

14. The apparatus according to claim 11, wherein the brush head forms a portion of the reservoir.

15. The apparatus according to claim 11, further comprising a seal around a perimeter of the brush head.

16. The apparatus according to claim 15, further comprising a snap fit lever for removably engaging the brush head and the seal.

17. The apparatus according to claim 11, further comprising a plunger being mechanically engaged with the plunger plate.

18. The apparatus according to claim 17, wherein the plunger further comprises a knob and a shaft connected to the knob.

19. The apparatus according to claim 18, further wherein the shaft has a threaded configuration for simultaneous rotation about a center axis and linear movement of the plunger plate along the center axis for engaging a fluid in the reservoir.

* * * * *